US009939783B2

(12) United States Patent
Hilario et al.

(10) Patent No.: US 9,939,783 B2
(45) Date of Patent: Apr. 10, 2018

(54) WATER RESISTANT VENT IN AN ELECTRONIC DEVICE

(71) Applicant: Apple Inc., Cupertino, CA (US)

(72) Inventors: Alvin J. Hilario, Los Altos, CA (US); Jason J. Huey, San Francisco, CA (US); Moahni L. Maharaj, Fremont, CA (US)

(73) Assignee: Apple Inc., Cup, CA (US)

( * ) Notice: Subject to any disclaimer, the term of this patent is extended or adjusted under 35 U.S.C. 154(b) by 190 days.

(21) Appl. No.: 14/830,658

(22) Filed: Aug. 19, 2015

(65) Prior Publication Data

US 2017/0051769 A1 Feb. 23, 2017

(51) Int. Cl.
*G04B 37/00* (2006.01)

(52) U.S. Cl.
CPC ..... *G04B 37/00* (2013.01)

(58) Field of Classification Search
USPC ..... 137/13; 454/370; 181/149
See application file for complete search history.

(56) References Cited

U.S. PATENT DOCUMENTS 4,683,587 A 7/1987 Silverman
6,512,834 B1 1/2003 Banter et al.
6,932,187 B2 8/2005 Banter et al.
7,743,880 B2 * 6/2010 Matsumura ..... B61D 17/185 181/151
8,794,373 B1 * 8/2014 Lin ..... B01D 53/0407 181/151
8,942,402 B2 * 1/2015 Yuasa ..... H04R 1/02 381/332
9,038,773 B2 * 5/2015 Banter ..... G10K 11/002 181/286
9,226,076 B2 * 12/2015 Lippert ..... H04R 1/023
9,363,589 B2 * 6/2016 Lippert ..... H04R 1/023
2007/0165895 A1 * 7/2007 Matsumura ..... H04R 1/2803 381/351
2014/0125619 A1 * 5/2014 Panther ..... G06F 3/04883 345/173
2017/0030851 A1 * 2/2017 Kardassakis ..... H02H 5/083

* cited by examiner

*Primary Examiner* — Craig Schneider
*Assistant Examiner* — Daphne M Barry
(74) *Attorney, Agent, or Firm* — Downey Brand LLP

(57) ABSTRACT

An electronic device includes a compound designed to raise a surface tension of a water-based solution. The electronic device may include a vent feature to allow air to pass through the vent feature such that the air reaches a component in the electronic device. The vent feature may include a first vent structure and a second vent structure, both of which combine to confine the compound. When the water-based solution passes through an electronic device opening, the water-based solution may reach the first vent structure. If a surface tension is sufficiently low, the water-based solution may pass through the first vent structure. However, the water-based solution may then reach the compound causing the compound to dissociate, forming form positive and negative ions that attract molecules of the water-based solution. Then, the water-based solution surface tension increases and does not pass through the first vent structure or the second vent structure.

20 Claims, 7 Drawing Sheets

WATER RESISTANT VENT IN AN ELECTRONIC DEVICE

FIELD

The following disclosure relates to an electronic device. In particular, the following disclosure relates to an electronic device having a compound in a vent feature, the compound configured to interact with water (or a water-based solution) such that a surface tension of the water increases and is prevented from passing completely through the vent feature.

BACKGROUND

Electronic devices may include certain features to enhance a user experience. For example, an electronic device may include a sensing element designed to monitor the user. Further, the electronic device may include a speaker module designed to emit acoustic sound. In order to emit the acoustic sound, the electronic device may include an opening and a sound path.

However, having an opening in the enclosure may render the electronic device susceptible ingress of other compounds. For example, when the electronic device is a wearable electronic device worn around a wrist, the wearable electronic device may be exposed to ingress of a compound such as water. Even in instances in which a barrier exists between the sensing element and the compound, water in the form of water vapor may penetrate the barrier. In some cases, prior to entering the electronic device, surfactant molecules may interact with the water thereby lowering the surface tension of the water, allowing the water to ingress through barriers the water could not otherwise ingress. Further, the wearable electronic device may include a glass or other transparent surface to accommodate the sensing element. When water or vapor sufficient ingress in the electronic device, the water may condensate on the glass surface. As a result, the condensation may not only affect the appearance of the wearable electronic device, but also impede the ability of the sensing element to monitor the user.

SUMMARY

In one aspect, an electronic device is described. The electronic device may include a housing having walls that define an interior volume and arranged to carry an operational component within the interior volume. The housing may include an opening. The housing may further include a vent feature configured to allow ambient air into the interior volume and prevent a solution from ingress to the interior volume. Further, the vent feature may include a compound that increases a surface tension of the solution. This may prevent further flow of the solution through the vent feature.

In another aspect, a wearable electronic device is described. The wearable electronic device may include a sensing element. The wearable electronic device may further include a vent feature. The vent feature may include a first material having a first opening. The vent feature may further include a second material having a second opening. The wearable electronic device may further include a compound disposed between the first material and the second material. The compound may be configured to interact with a water-based solution that enters through the first opening such that the water-based solution increases from a first surface tension to a second surface tension to prevent the water-based solution from passing through the second opening.

In another aspect, a method for preventing ingress of a water-based solution to a component in an electronic device is described. The method may include receiving a compound in an enclosure of the electronic device. The method may further include disposing the compound between a first vent structure and a second vent structure in the enclosure. In some embodiments, when the water-based solution enters the enclosure and passes through the first vent structure, the compound is configured to interact with the water-based solution to increase a surface tension of the water-based solution to prevent the water-based solution from passing through the second vent structure.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
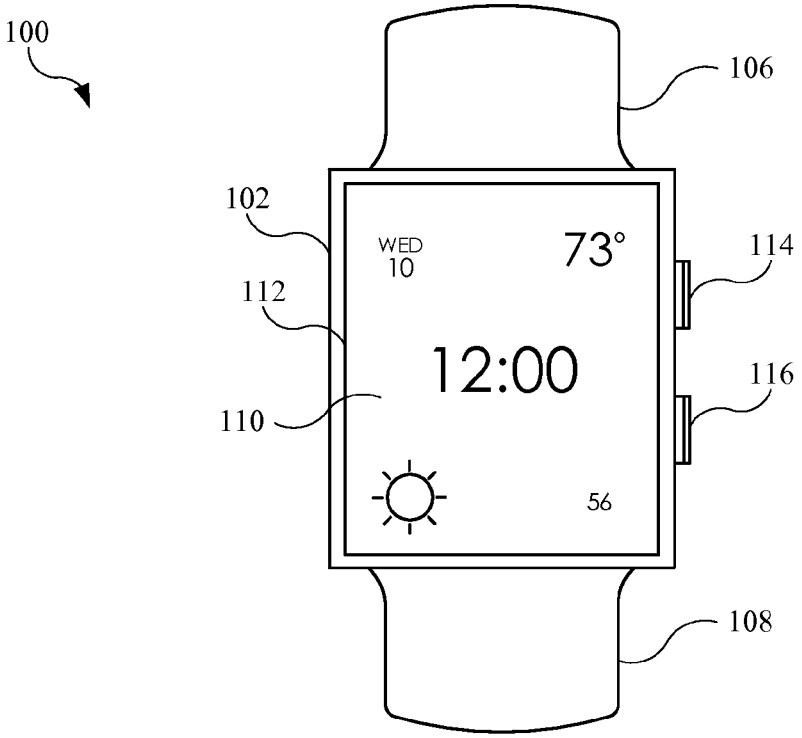
FIG. 1 illustrates a front view of an embodiment of an electronic device, in accordance with the described embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to an electronic device modified to retain a compound that may interact with a solution (such as a water-based solution or compound) that enters the electronic device. The solution may take the form of a liquid state and/or a gas (vapor) state. In some embodiments, the electronic device is a wearable electronic device secured with an appendage (such as an arm or wrist of an arm) of a user. In these embodiments, the user may expose the wearable electronic device to the water-based solution during routine activities, such as washing the user's hands.

Generally, the wearable electronic device may include some barrier that prevents the water-based solution from unwanted ingress of the water-based solution. However, when the water-based solution is mixed with a surfactant (such as soap), the water molecules no longer exclusively bond with other water molecules causing the surface tension of the water-based solution to decrease. As a result, the water-based solution is more likely to extend through small openings causing unwanted ingress.

However, the compound disposed in the wearable electronic device is designed to interact with the water-based solution and raise the surface tension of the water-based solution. The compound may be a solid compound, such as a salt. Also, the compound may include one or more elements having a characteristic of relatively high reactivity with water. For example, the solid compound in the form of a salt may include potassium chloride (NaCl) molecules or sodium chloride (KCl) molecules. The salt may interact with the water-based solution causing atoms of the salt molecules to dissociate with one another. When dissociated, these atoms may be ionized in the form of, for example, a positive potassium (or sodium) ion and a negative chloride ion. Further, the atoms of a water-based solution, which may include two hydrogen atoms and an oxygen atom, may attract or bond with these ionized molecules. For example, the (partially positive) hydrogen atoms, having a single electron, may be attracted to the chloride ion while the (partially negative) oxygen atom may be attracted to the potassium (or sodium) ion. These attraction forces formed by the compound increase the surface tension of the water-based solution. In particular, the water-based solution may include several water droplets, each of which may include an increased surface tension at an outer surface of the water droplet based on the attraction or bonding process previously described. As a result, the intermolecular forces between molecules of the water-based solution increase at the surface, and the water-based solution tends to resist a change in shape.

In some cases, the compound is disposed in a vent feature designed to allow ambient air to extend through the wearable electronic device and to a component, such as a barometer. In this regard, the vent feature may include a first vent structure and a second vent structure, each of which may take the form of a mesh feature. Accordingly, the first vent structure and a second vent structure may include one or more openings. However, when the compound is secured with the vent feature, the water-based solution may extend through the openings and interact with the compound in a manner described above. As a result, the relatively high surface tension of the water-based solution is sufficient to maintain the water droplets of the water-based solution at a size greater than the openings of the vent feature. Further, the relatively high surface tension of the water-based solution causes the water droplets to remain in a generally spherical shape such that the shape does not alter and extend through the openings of the vent feature. As a result, the water-based solution may eventually evaporate leaving the compound between the first vent structure and the second vent structure.

The embodiments shown and described are designed as a modification to an electronic device without altering the form factor or footprint of the electronic device. In other words, the electronic device does not increase in size and shape based upon the described modification. This may be beneficial instances when, for example, the electronic device is a wearable electronic device as a user may prefer the wearable electronic device to maintain a desired proportion with respect to an appendage (such as a wrist) of the user.

These and other embodiments are discussed below with reference to FIGS. 1-10. However, those skilled in the art will readily appreciate that the detailed description given herein with respect to these Figures is for explanatory purposes only and should not be construed as limiting.

FIG. 1 illustrates a front view of an embodiment of an electronic device 100, in accordance with the described embodiments. In some embodiments, the electronic device 100 is a mobile communication device, such as a smart phone. In other embodiments, the electronic device 100 is a tablet computing device. In the embodiment shown in FIG. 1, the electronic device 100 is a wearable electronic device designed to secure with an appendage (for example, an arm or a leg) of a user of the electronic device 100.

The electronic device 100 may include an enclosure 102 formed from a rigid material, such as a metal (including stainless steel or aluminum). The enclosure 102 may be coupled with a first band feature 106 and a second band feature 108, with the first band feature 106 and the second band feature 108 designed to secure the electronic device 100 with an appendage of a user. Also, the electronic device 100 may include a display module 110 designed to display visual content, including a day and a time of the day. In some embodiments, the display module 110 is a light-emitting diode ("LED") display. Further, in some embodiments, the display module 110 is an organic light-emitting diode ("OLED") display. In addition to displaying time, the display module 110 may also display visual content based upon applications, or "apps," stored on a memory circuit (not shown) disposed between the enclosure 102 and the display module 110. Also, the electronic device 100 may pair, via wireless communication, with an additional electronic device (not shown), such as a smart phone. In this manner, the display module 110 may further display visual content based upon apps stored on the additional electronic device. Also, the display module 110 may further include a cover glass 112 disposed over the display module 110.

The electronic device 100 may include several input features electrically coupled with one or more processors (not shown), and designed to control the display module 110. For example, as shown in FIG. 1, the electronic device 100 includes a first control input 114 and a second control input 116, each of which may be partially disposed in openings of the enclosure 102. The first control input 114 may take the form of a dial design for clockwise and counter-clockwise rotation, with the rotation used to control the display module 110. Further, the first control input 114 may be depressed to define a further control input feature. The second control input 116 may take the form of a button that provides an additional control input feature when depressed. Although not shown, the first control input 114 and/or second control input 116 may be disposed in other locations of the enclosure 102. Also, the electronic device 100 may include more or fewer control inputs in other embodiments. Further, the electronic device 100 may include a touch sensor (not shown) disposed behind (and in some cases integrated) with the display module 110. This allows the user to further control the display module 110 by depressing the cover glass 112 triggering the touch sensor to generate a control input and alter the visual content of the display module 110.

Figure 2:
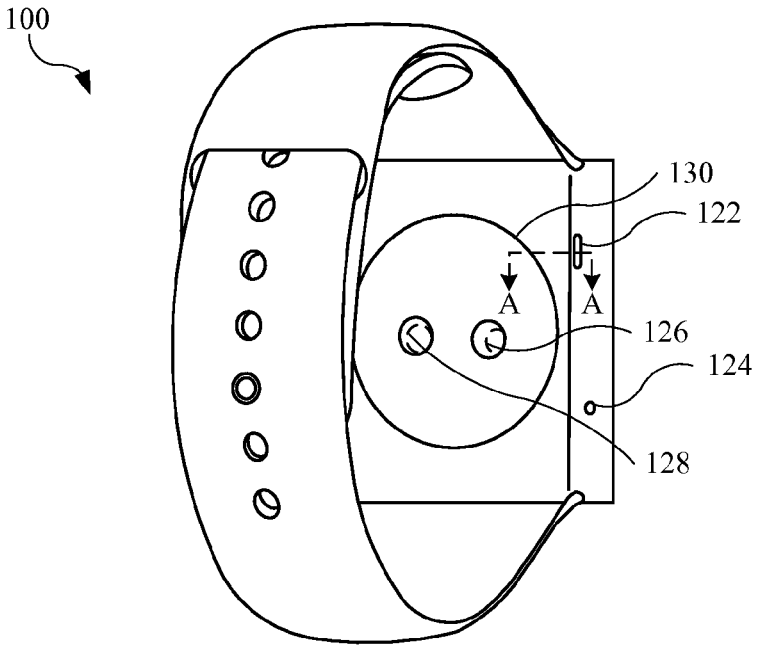
FIG. 2 illustrates a rear view of the electronic device shown in FIG. 1, showing several openings in the enclosure.

FIG. 2 illustrates a rear view of the electronic device shown in FIG. 1, showing several openings in the enclosure 102. As shown, the first band feature 106 is engaged with the second band feature 108 to define a closed configuration allowing the electronic device 100 to be secured with an appendage of a user. The electronic device 100 may include a first opening 122 in the enclosure 102 that may allow, for example, an output of audible sound from a speaker module (not shown) disposed in the enclosure 102. Also, the electronic device 100 may include a second opening 124 in the enclosure 102 that may allow, for example, an input of audible sound to a microphone (not shown) disposed in the enclosure 102. Although the first opening 122 and the second opening 124 are shown in distinct locations, the first opening 122 and the second opening 124 may vary in location along the enclosure 102, and further, may vary in size and shape. Further, the number of openings may vary according to the functionality of the electronic device 100. For example, an additional opening (not shown) may be used in conjunction with the first opening 122 to enhance the audible sound.

The electronic device 100 shown in FIG. 2 may include additional features. For example, the electronic device 100 may include a light source 126 designed to emit light in the form of light pulses. In some embodiments, the light source 126 includes a light-emitting diode ("LED"). Further, in some embodiments, the light source 126 includes a generally green color. Also, the electronic device 100 may include a sensing element 128 designed to sense light from the light source 126 that is reflected by, for example, a user wearing the electronic device 100. Accordingly, in some embodiments, the sensing element 128 is a photoelectric sensor or photodiode. Although a single light source and a single sensing element are shown, other embodiments may include two or more light sources as well as two or more sensing elements. Also, a cover 130, formed from a material such as glass or crystal, may overlay the light source 126 and the sensing element 128, with the cover 130 being transparent in locations corresponding to the light source 126 and the sensing element 128.

When worn by the user on the user's wrist, the sensing element 128 in conjunction with the light source 126 may be used to determine, for example, a user's heart rate by shining light from the light source 126 that passes through the skin to monitor blood flow. Based upon the amount of light from the light source 126 absorbed by the blood flow, the electronic device 100 can use the sensing element 128 to assist in determining the user's heart rate. In this regard, the transparent material that covers the light source 126 and the sensing element 128 should not include any condensation, residue or other unwanted substance that hinders their effectiveness.

Figure 3:
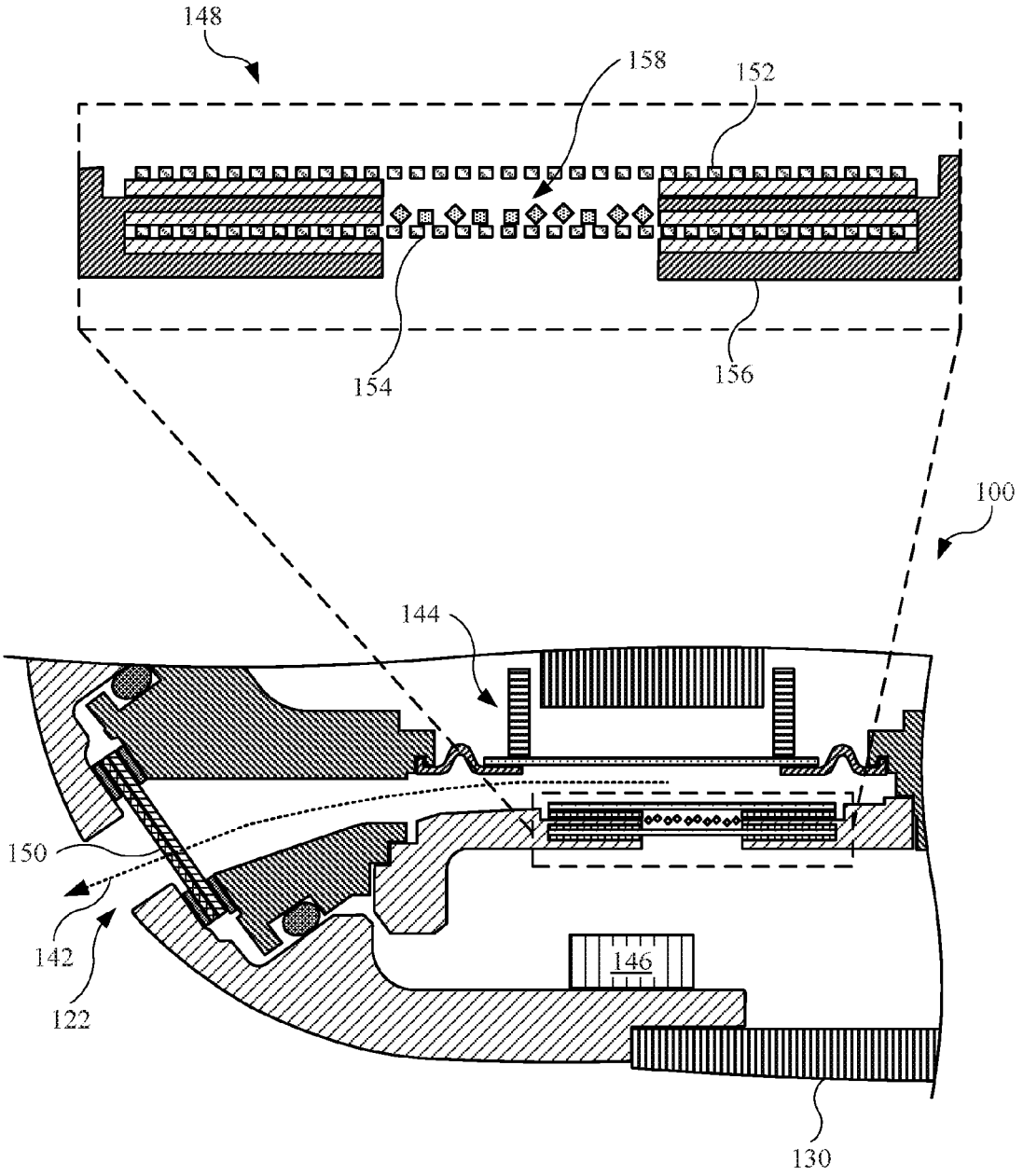
FIG. 3 illustrates a cross sectional view of the electronic device shown in FIG. 2, taken along line A-A in FIG. 2.

In some cases, water (in liquid or vapor form) may enter the electronic device 100 via the first opening 122 and/or the second opening 124. This may cause condensation in a location between the cover 130 and the light source 126, and/or a location between the cover 130 and the sensing element 128. However, the electronic device 100 may include one or more modifications to prevent condensation in these locations. For example, FIG. 3 illustrates a cross sectional view of the electronic device 100 shown in FIG. 2, taken along line A-A in FIG. 2. A sound path 142 illustrates an exemplary path that may be taken by audible sound generated from a speaker module 144 and exiting the electronic device 100 via the first opening 122. Also, the path defined by the sound path 142 may further be used to allow ambient air to enter the electronic device 100 in the opposite direction, with the air used by a second sensing element 146 located in an interior region of the electronic device 100. In some embodiments, the second sensing element is a barometer designed to measure an elevation of the electronic device 100 based upon air received at the barometer. However, in other embodiments, the second sensing element 146 is another operational component of the electronic device 100.

Also, a vent feature 148 may be positioned between the sound path 142 and the second sensing element 146. An enlarged view of the vent feature 148 shows several features of the vent feature 148. For example, the vent feature 148 may include a first vent structure 152 that may include a mesh feature defining several opening allowing air to pass through the first vent structure 152. The first vent structure 152 may be formed from a water-resistant material, such as a polymer, or may be coated with a water-resistant material. Also, the vent feature 148 may further include a second vent structure 154 proximate to the first vent structure 152. As shown, the second vent structure 154 may extend through an opening of a cover 156. In this manner, the second vent structure 154 may be incorporated into the cover 156 without altering (for example, increasing) the existing dimensions of the electronic device 100. Also, the second vent structure 154 may be formed from any material and may include any structural features as the first vent structure 152. Accordingly, the vent feature 148 may be referred to as a relief vent allowing ambient air to pass through the vent feature 148 thereby preventing unwanted air pressure due to buildup of excess air. In other words, air may pass through the first vent structure 152 and the second vent structure 154. In this manner, the vent feature 148 may allow the second sensing element 146 to be exposed to the ambient air.

In addition, the vent feature 148 may include a compound 158 bound between the first vent structure 152 and the second vent structure 154. The compound 158 may be several particles disposed between the first vent structure 152 and the second vent structure 154. In this regard, the first vent structure 152 and the second vent structure 154 may be referred to as a first retaining feature and a second retaining feature, respectively, designed to retain the compound 158. In some embodiments, the compound 158 is a salt compound, which may include, by way of example, potassium chloride and/or sodium chloride. However, in other embodiments, the compound 158 is a fluorocarbon having a compound makeup of $C_xF_y$, in which "x" and "y" may be variables representing a number of carbon atoms and a number of fluoride atoms of the compound. Still, in other embodiments, the compound 158 includes oil having a viscosity and surface tensions sufficient to remain between the first vent structure 152 and the second vent structure 154. In any embodiment, the compound 158 may include one or more properties causing the molecules of the compound 158 to dissociate when exposed to water, and further causing the compound 158 to dissolve in some cases. Despite the first vent structure 152 and the second vent structure 154 having openings, the particles of the compound 158 may include a size and a shape such that the particles of the particles of the compound 158 do not pass through either vent structure and remain bound between the vent structures. Also, the compound 158 may be used to prevent water molecules from completely passing through the vent feature 148 and depositing on the cover 130 (also shown in FIG. 2). The features and functions of the compound 158 will be discussed in detail below.

Figure 4:
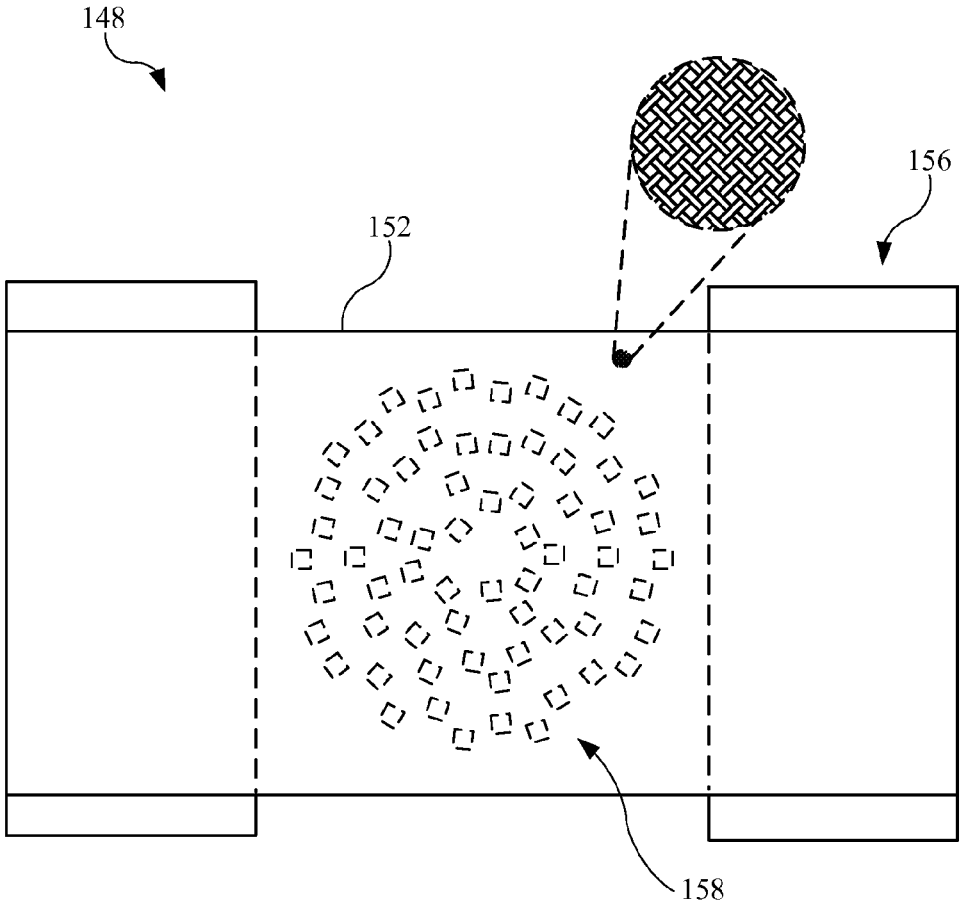
FIG. 4 illustrates a plan view of the vent feature shown in FIG. 3.

FIG. 4 illustrates a plan view of the vent feature 148 showing the first vent structure 152 positioned over the compound 158. As shown in the enlarged view, the first vent structure 152 includes a mesh feature defining several openings large enough to allow air to pass through the first vent structure 152, yet small enough to prevent particles of the compound 158 from extending through the openings of the first vent structure 152. The second vent structure 154 (shown in FIG. 3) may include a similar mesh feature as that of the first vent structure 152. With the second vent structure 154 disposed below (or proximate to) the first vent structure 152, the compound 158 is bound between the first vent structure 152 and the second vent structure 154. Further, the cover 156 may work in conjunction with the first vent structure 152 and the second vent structure 154 to maintain the compound 158 within the vent feature 148. Also, although the compound 158 is shown in a generally circular pattern, the compound 158 may be dispersed anywhere throughout a space defined by the first vent structure 152, the second vent structure 154, and the cover 156.

Referring again to FIG. 3, while the sound path 142 may include multiple desired functionalities, the sound path 142 in conjunction with the first opening 122 may expose the electronic device 100 to ingress of contaminants or other substances. For example, water, in liquid or vapor form, may extend through the sound path 142 via the first opening 122 and an acoustic mesh 150. Water droplets include a surface tension such that adjacent water molecules at the surface of each water droplet tend to bond with each other causing the water droplet form a spherical, or substantially spherical, shape. Further, the surface tension tends to resists some forces acting on the water droplets causing the water droplets to maintain their spherical shape. As such, despite the mesh structure, the first vent structure 152 may sufficiently prevent water from further ingress of the water droplets.

Figure 5:
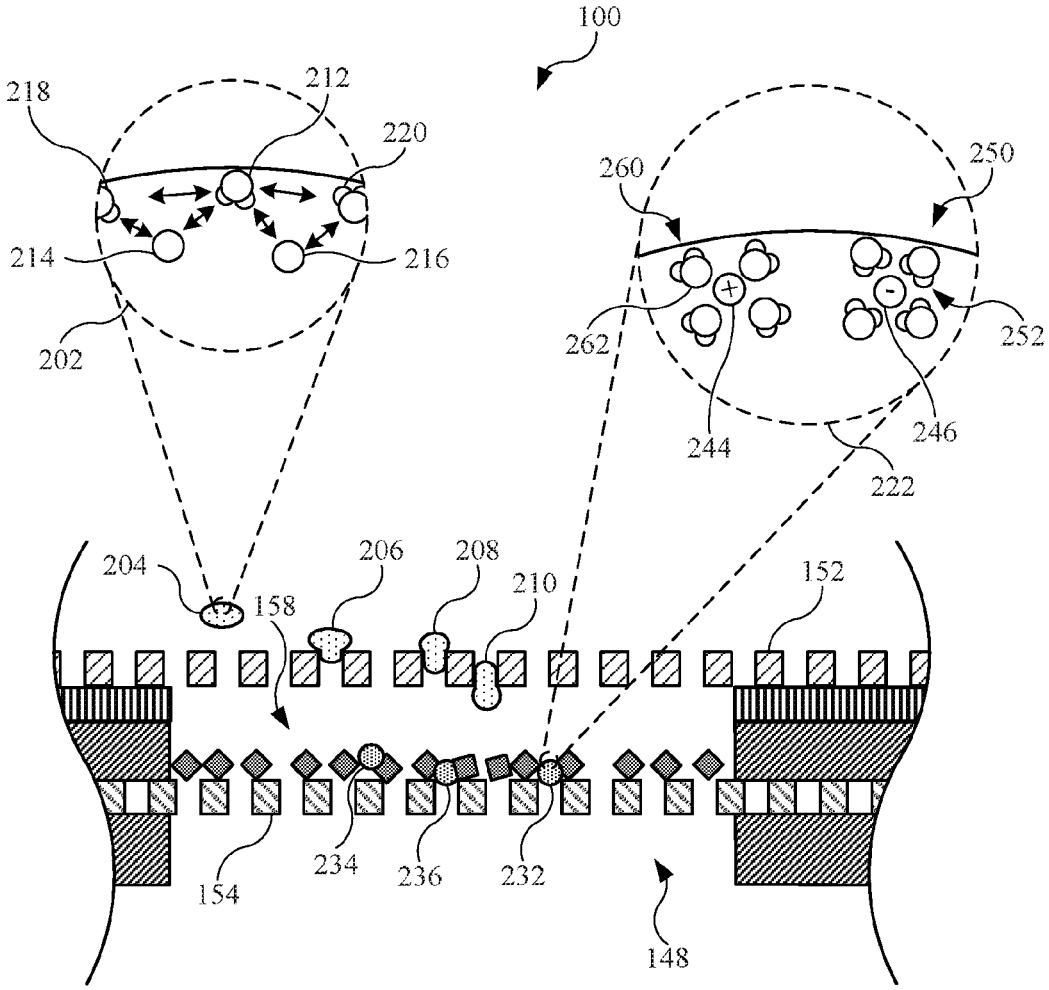
FIG. 5 illustrates a cross sectional view of the vent feature shown in FIG. 3, showing several water droplets interacting with the vent feature at different stages.

However, some activities performed by a user of the electronic device 100 may contribute to ingress of water having a reduced surface tension, thus allowing water, or water droplets), to penetrate the first vent structure 152. For example, FIG. 5 illustrates a cross sectional view of the vent feature 148 in FIG. 3, showing several water droplets of a water-based solution interacting with the vent feature 148 at different stages. While wearing the electronic device 100 on his/her wrist, the user may expose the electronic device 100 to water when, for example, washing the user's hands or washing dishes. These exemplary activities may expose the electronic device 100 to water-soap slurry. Soap may be referred to as a surfactant, or a compound that lowers or breaks up surface tension between water droplets of the water-based solution. The surfactant may be a compound or solution that allows the water-based solution to reduce the surface tension of the water-based solution allowing the water-based solution to more readily take on different shapes and sizes.

As previously described, water molecules of a water-based solution may extend through the first opening 122 and the sound path 142 of the electronic device 100 shown in FIG. 3. Also, as generally known, each water molecule may include two hydrogen atoms bonded with an oxygen atom to form an $H_2O$ compound. The first enlarged view 202 illustrates a first water droplet 204, showing several water molecules interacting with several surfactant molecules. For example, the first enlarged view 202 shows a first water molecule 212 at the surface of the first water droplet 204. In the presence of a first surfactant molecule 214 and a second surfactant molecule 216, the first water molecule 212 may form a bond with a second water molecule 218 or a third water molecule 220. Alternatively, the first water molecule 212 may form a bond with the first surfactant molecule 214 or the second surfactant molecule 216, both of which are located at the surface of the first water droplet 204. The bi-directional arrows shown in the first enlarged view 202 show examples of several potential bonds between water molecules that may be formed based upon the interaction with the surfactant molecules. With the first water droplet 204 interacting with several surfactant molecules, the first water droplet 204 may undergo a reduced surface tension, as compared to a water droplet having not interacted with surfactant molecules.

The reduced surface tension of the first water droplet 204 causes the first water droplet 204 to lose its generally spherical shape. For example, as shown in FIG. 5, the first water droplet 204 may include an elliptical shape (whereas the first water droplet 204 may include a generally spherical shape when not interacting with surfactant molecules). Further, the first water droplet 204 may be exemplary of additional water droplets. For example, a second water droplet 206, a third water droplet 208, and a fourth water droplet 210 may include several water molecules having interactions with surfactant molecules in a manner similar to those of the first water droplet 204, causing the second water droplet 206, the third water droplet 208, and the fourth water droplet 210 to change their readily shape. For example, as shown in FIG. 5, the second water droplet 206, the third water droplet 208, and the fourth water droplet 210 may readily change their shape, due to the decreased surface tension. As a result, when engaged with the first vent structure 152, these water droplets may extend through the openings of the first vent structure 152 and ultimately pass completely through the first vent structure 152.

However, when the water droplets pass through the first vent structure 152, the water droplets may interact with the compound 158 bound by the first vent structure 152 and the second vent structure 154. The compound 158 may interact with the water droplets to counteract the reduced surface tension caused by the surfactant molecules. For example, the second enlarged view 222 shows a fifth water droplet 232 interacting with the compound 158. The fifth water droplet 232 may represent a droplet having passed through the first vent structure 152 in response to interacting with a surfactant molecule, thus having a reduced surface tension. The compound 158 may take the form of a salt (previously described) that includes, as a non-limiting example, a sodium molecule bonded with a chlorine molecule. However, when the compound 158 interacts with the fifth water droplet 232, the compound 158 may dissociate causing ionized molecules. For example, a molecule of the compound 158 may dissolve into a positive ion 244 (or positively-charged ion) and a negative ion 246 (or negatively-charged ion). When a sodium-chloride molecule dissolves, a sodium atom, also referred to as a cation, may include a positive charge as the sodium atom loses an electron to the chlorine atom during an atomic bond between the sodium atom and the chlorine atom. The positive ion 244 may represent the sodium ion. Further, when the sodium-chloride molecule dissolves, a chloride atom, also referred to as an anion, may include a negative charge as a chlorine atom gains an electron from the sodium atom to form a chloride ion during an atomic bond between the sodium atom and the chlorine atom. The negative ion 246 may represent the chloride ion.

The water molecules may attract to the ionized atoms. For example, as shown in the second enlarged view 222, when the compound 158 dissociates into ions, a first water molecule 250 that includes hydrogen atoms 252, each of which may be "partially positively charged," may be attracted to, and even bond with, the negative ion 246. The first water molecule 250 may be representative of several other water molecules surrounding the negative ion 246, as shown in the second enlarged view 222. Conversely, a second water molecule 260 that includes an oxygen atom 262, each of which may be "partially negatively charged," may be attracted to, and even bond with, the positive ion 244. The second water molecule 260 may be representative of several other water molecules surrounding the positive ion 244, as shown in the second enlarged view 222.

The attraction forces of the positive ion 244 and the negative ion 246 at the surface of the fifth water droplet 232 causes an increases surface tension of the fifth water droplet 232. This is due in part to the first water molecule 250 and the second water molecule 260 remaining attracted to their respective ions, rather than becoming attracted to other molecules (as shown in the first enlarged view 202). Moreover, the surface tension of the fifth water droplet 232 is sufficiently increased such that the fifth water droplet 232 remains between the first vent structure 152 and the second vent structure 154, regardless of an orientation of the electronic device 100. In other words, the fifth water droplet 232 may retain a spherical, or substantially spherical, shape and does not pass through the openings of the second vent structure 154. Further, the fifth water droplet 232 may be exemplary of additional water droplets. For example, a sixth water droplet 234 and a seventh water droplet 236 may include several water molecules interacting with the compound 158 in a manner similar to those of the fifth water droplet 232, causing the sixth water droplet 234 and a seventh water droplet 236 to increase their respective surface tensions, and remain bound between the first vent structure 152 and the second vent structure 154. It will be appreciated that the second water droplet 206, the third water droplet 208, and the fourth water droplet 210 may ultimately interact with the compound 158 to increase their respective surface tensions. With the water droplets bound between the first vent structure 152 and the second vent structure 154, the water droplets may eventually evaporate without passing through the second vent structure 154, and the ionized atoms may combine again to form the compound 158.

Although the prior embodiments illustrates and describes a compound disposed solely between two vent structures, FIGS. 6-10 illustrates various modifications for carrying the compound. These modifications may be used to further confine the compound. Also, it will be appreciated that the vent structures and the compounds described in FIGS. 6-10 may include any material or shape, and may serve any purpose, previously described for a vent structure and a compound, respectively. Also, the vent features and the compounds described and shown in FIGS. 6-10 may also be used in an electronic device.

Figure 6:
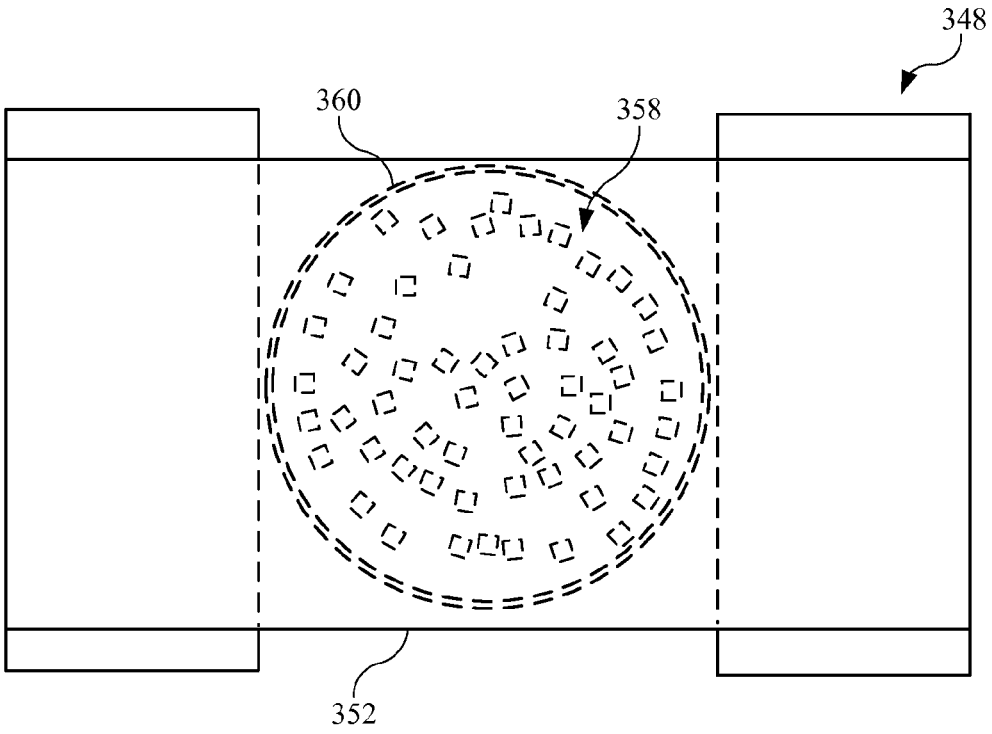
FIG. 6 illustrates a plan view of an alternate embodiment of a vent feature, showing a compound positioned in a holding element.

FIG. 6 illustrates a plan view of an alternate embodiment of a vent feature 348, showing a compound 358 positioned in a holding element 360. As shown, the holding element 360 may be disposed between a first vent structure 352 and a second vent structure (not shown). In some embodiments, the holding element 360 takes the form of a cup or a dish designed to laterally confine the compound 358. The holding element 360 may be formed from a lightweight material, such as a polymer, in order to minimize an increase in weight of an electronic device that includes the vent feature 348. Also, the holding element 360 may be a water-resistant holding element.

Figure 7:
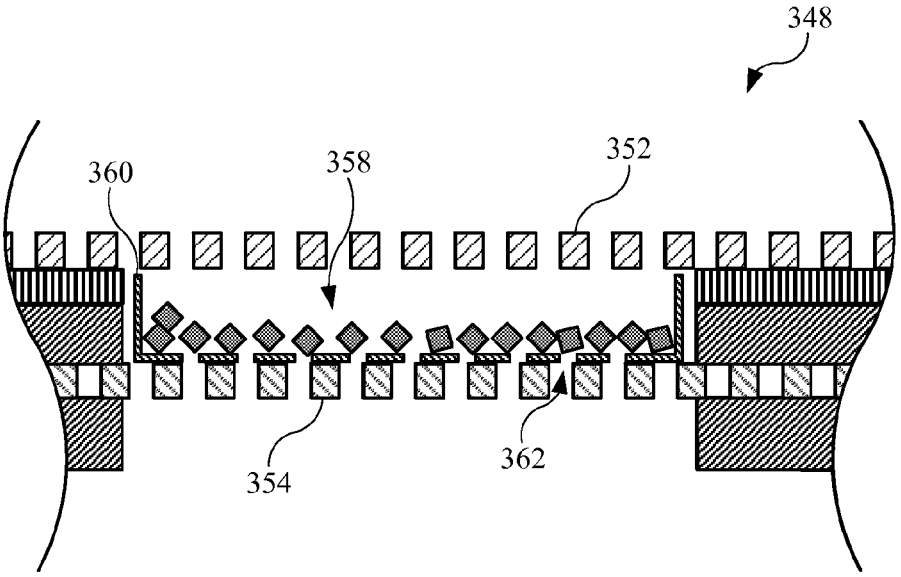
FIG. 7 illustrates a cross sectional view of the vent feature and the holding element shown in FIG. 6.

FIG. 7 illustrates a cross sectional view of the vent feature 348 and the holding element 360 shown in FIG. 6. As shown, the holding element 360 may include several openings, including a first opening 362, that are at least partially aligned with the openings of the second vent structure 354. The openings of the holding element 360 may be designed to further maintain the compound 358 from passing through the second vent structure 354. In this regard, the openings of the holding element 360 may include a smaller size and shape than those of the second vent structure 354. Regardless of any relative size and shape, the openings of the holding element 360 allow the vent feature 348 to continue the allow air through the vent feature 348.

Figure 8:
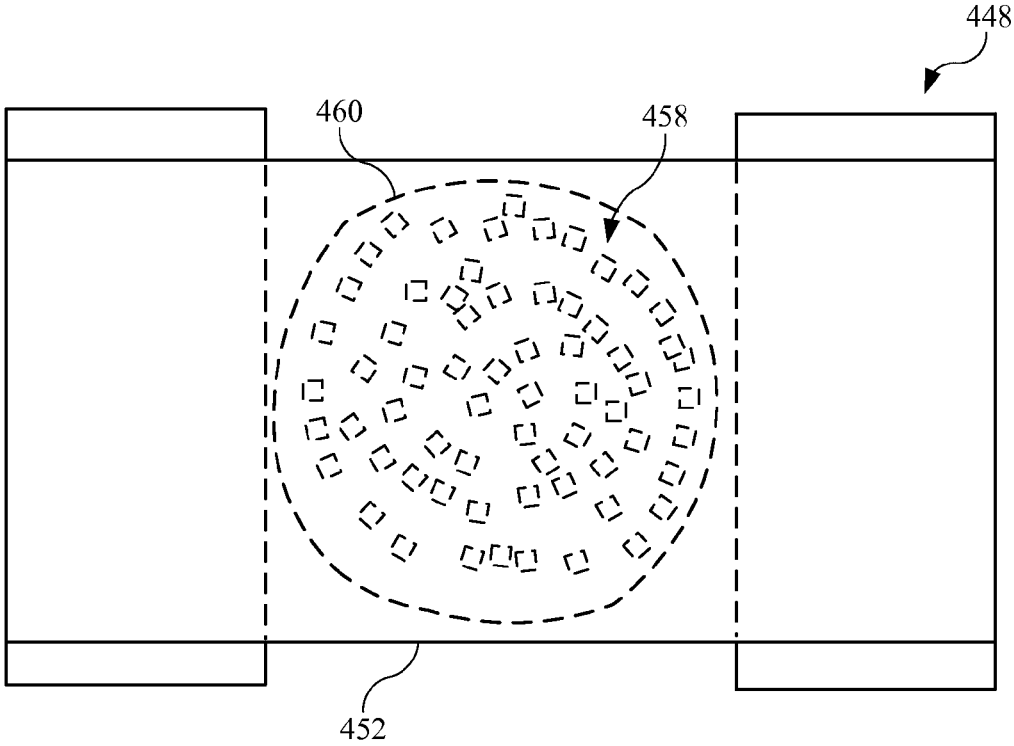
FIG. 8 illustrates a plan view of an alternate embodiment of a vent feature, showing a compound positioned in an alternative embodiment of a holding element.

FIG. 8 illustrates a plan view of an alternate embodiment of a vent feature 448, showing a compound 458 positioned in a holding element 460. As shown, the holding element 460 may be disposed between a first vent structure 452 and a second vent structure (not shown). In some embodiments, the holding element 460 takes the form of a net or a vessel designed to further confine the compound 458. The holding element 460 may be formed from a lightweight material, such as a mesh material formed from, for example, nylon or string, in order to minimize an increase in weight of an electronic device that includes the vent feature 448. Also, the holding element 460 may be a water-resistant holding element.

Figure 9:
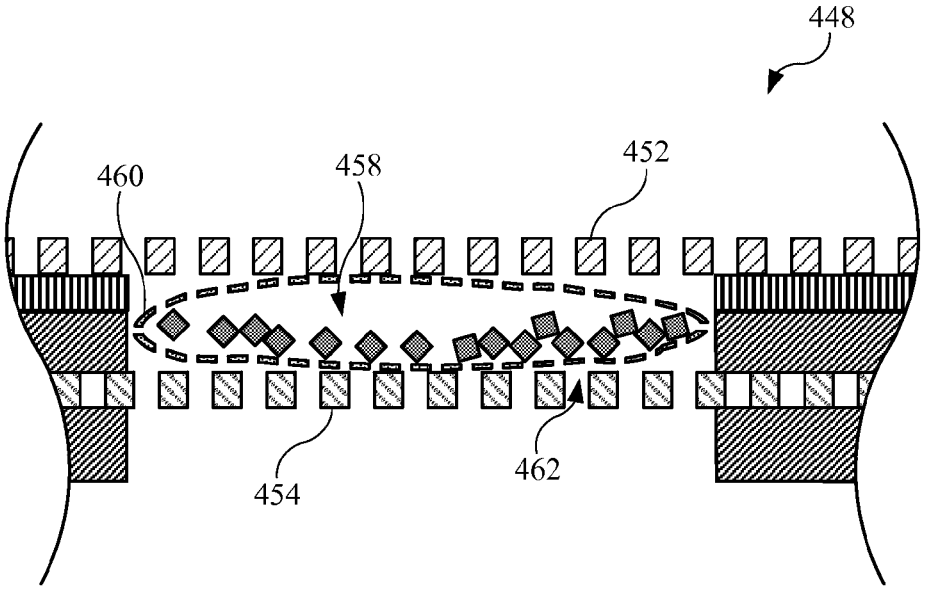
FIG. 9 illustrates a cross sectional view of the vent feature and the holding element shown in FIG. 8.

FIG. 9 illustrates a cross sectional view of the vent feature 448 and the holding element 460 shown in FIG. 8. As shown, the holding element 460 extend completely around the compound 458 and may include several openings, including a first opening 462, that are at least partially aligned with the openings of the second vent structure 454. The openings of the holding element 460 may be designed to further maintain the compound 458 from passing through the second vent structure 454. Also, an electronic device that includes the holding element 460 may be oriented in various manners without the compound 458 becoming unconfined from the holding element 460. In this regard, the openings of the holding element 460 may include a smaller size and shape than those of the second vent structure 454. Regardless of any relative size and shape, the openings of the holding element 460 allow the vent feature 448 to continue the allow air through the vent feature 348.

Figure 10:
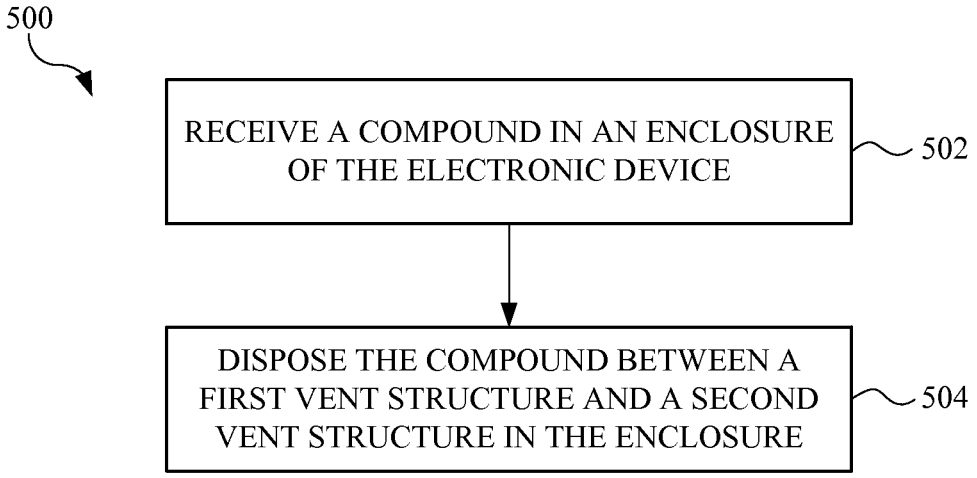
FIG. 10 illustrates a flowchart showing a method for preventing ingress of a water-based solution to a component in an electronic device, in accordance with the described embodiments.

FIG. 10 illustrates a flowchart 500 showing a method for preventing ingress of a water-based solution to a component in an electronic device, in accordance with the described embodiments. In step 502, a compound is received in an enclosure of the electronic device. The compound may be selected from a salt, a fluorocarbon, and/or an oil-based compound. In either event, the compound is designed to interact with the water-based solution entering an opening of the electronic device.

In step 504, the compound is disposed between a first vent structure and a second vent structure in the enclosure. In some embodiments, the first vent structure and the second vent structure include a first mesh feature and a second mesh feature, respectively. Also, when the water-based solution enters the enclosure and passes through the first vent structure, the compound interacts with the water-based solution to increase a surface tension of the water-based solution to prevent the water-based solution from passing through the second vent structure. The compound may dissolve into several ionized atoms that attract, or bond with, molecules of the water-based solution. This attraction or bonding causes a surface tension of the water-based solution to increase. As a result, the water-based solution reduces a likelihood of changing its shape and remains in spherical, or substantially spherical, shape. Further, the increased surface tension of the water-based solution prevents the water-based solution from passing through the first vent structure and the second vent structure, and the water-based solution is prevented from further ingress in the electronic device.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic device, comprising:

a housing having walls that define an interior volume, the housing carrying an operational component within the interior volume, the walls comprising a sidewall having a through hole that opens to the interior volume;

a vent feature positioned in the interior volume between the operational component and the through hole; and a surface tension enhancing compound carried within the vent feature, the surface tension enhancing compound capable of increasing a surface tension of a liquid that passes through the through hole and enters the vent feature to define an increased surface tension of the liquid, wherein the increased surface tension prevents the liquid from exiting the vent feature.

2. The electronic device of claim 1, wherein the vent feature comprises a first mesh feature having a first opening and a second mesh feature having a second opening, the first opening and the second opening each having a size smaller than a size of the surface tension enhancing compound, and wherein the first opening and the second opening allow ambient air to flow to the operational component.

3. The electronic device of claim 2, wherein when the liquid extends through the first mesh feature, the liquid remains between the first mesh feature and the second mesh feature based upon the increase of the surface tension of the liquid.

4. The electronic device of claim 2, wherein the operational component comprises a barometer.

5. The electronic device of claim 1, wherein the surface tension enhancing compound comprises a material selected from a group consisting of a salt and a fluorocarbon.

6. The electronic device of claim 1, wherein the surface tension enhancing compound, when interacting with the liquid, forms a positive ion and a negative ion, wherein the positive ion and the negative ion attract molecules of the liquid causing the liquid to include the increased surface tension.

7. The electronic device of claim 1, further comprising:

a cover glass coupled with the housing;

a display module covered by the cover glass;

a first band extending from a first end of the housing; and a second band extending from a second end of the housing, the second end opposite the first end.

8. A wearable electronic device, comprising:

a sensing element;

a vent feature comprising a first layer having a first opening, the vent feature further comprising a second layer having a second opening; and a compound disposed between the first layer and the second layer, the compound capable of interacting with a liquid that enters through the first opening such that the liquid increases from a first surface tension to a second surface tension, the compound preventing the liquid at the second surface tension from passing through the second opening and reaching the sensing element.

9. The wearable electronic device of claim 8, wherein the first layer comprises a mesh material that defines the first opening.

10. The wearable electronic device of claim 9, wherein the second layer comprises a mesh material that defines the second opening.

11. The wearable electronic device of claim 10, wherein the compound comprises a plurality of particles, and wherein each of the plurality of particles includes a size and a shape larger than the first opening and larger than the second opening.

12. The wearable electronic device of claim 8, wherein the compound ionizes when reacting with the liquid to form a positively charged ion and a negatively charged ion, and wherein the positively charged ion and the negatively charged ion increase the liquid to the second surface tension.

13. The wearable electronic device of claim 8, further comprising:

an enclosure including an opening; and a speaker module that emits an audible sound from the electronic device via the opening of the enclosure.

14. The wearable electronic device of claim 13, wherein the sensing element comprises a barometer that receives air via the opening of the enclosure and at least the first opening of the first layer, and wherein the vent feature is positioned between the opening and the barometer.

15. The wearable electronic device of claim 13, further comprising a band feature coupled with the enclosure, the band feature configured to secure the wearable electronic device with an appendage of a user.

16. The wearable electronic device of claim 8, wherein the compound comprises a salt that includes a potassium or sodium chloride.

17. A method for preventing ingress of a water-based solution to a component in an electronic device, the method comprising:

positioning a first vent structure and a second vent structure in an interior volume defined by an enclosure of the electronic device; and disposing a compound between the first vent structure and the second vent structure, wherein when the water-based solution enters the enclosure and passes through the first vent structure, the compound interacts with the water-based solution and causes an increased surface tension of the water-based solution, the water-based solution prevented from passing through the second vent structure based on the increased surface tension.

18. The method of claim 17, wherein the first vent structure includes a first opening, and wherein the second vent structure feature includes a second opening.

19. The method of claim 18, wherein disposing the compound between the first vent structure and the second vent structure comprises disposing a salt between the first vent structure and the second vent structure.

20. The method of claim 17, wherein when the compound interacts with the water-based solution, the compound dissociates to form a positive ion and a negative ion, the positive ion and the negative ion attracting molecules of the water-based solution.

* * * * *